US005718385A

United States Patent [19]

Fontell

[11] Patent Number: 5,718,385

[45] Date of Patent: Feb. 17, 1998

[54] CONTROL ARRANGEMENT FOR A FUEL INJECTION VALVE

[75] Inventor: Erkko Fontell, Vaasa, Finland

[73] Assignee: Wartsila Diesel International Ltd Oy, Helsinki, Finland

[21] Appl. No.: 662,826

[22] Filed: Jun. 12, 1996

[30] Foreign Application Priority Data

Jun. 15, 1995 [FI] Finland ..... 952939

[51] Int. Cl.[6] ..... F02M 47/00

[52] U.S. Cl. ..... 239/533.3; 239/533.9; 239/584; 123/445; 123/467

[58] Field of Search ..... 239/533.1, 533.2, 239/533.3, 533.4, 533.8, 533.9, 533.12, 533.14, 533.15, 583, 584, 585.1, 585.3, 585.4, 585.5, 596, 900, DIG. 19, 88, 96; 123/445, 467

[56] References Cited

U.S. PATENT DOCUMENTS

| | | | |
|---|---|---|---|
| 4,165,724 | 8/1979 | Yamamoto et al. | 123/445 |
| 4,167,168 | 9/1979 | Yamamoto | 123/467 |
| 4,317,541 | 3/1982 | Beardmore | 239/88 |
| 4,470,545 | 9/1984 | Deckard et al. | 239/88 |
| 4,684,067 | 8/1987 | Cotter et al. | 239/533.3 |
| 4,687,136 | 8/1987 | Ozu et al. | 239/533.8 |
| 4,852,808 | 8/1989 | Yamamoto | 239/533.3 |
| 4,993,637 | 2/1991 | Kanesaka | 239/96 |
| 5,263,645 | 11/1993 | Paul et al. | 239/533.8 |
| 5,529,024 | 6/1996 | Wirbeleit et al. | 239/96 |

FOREIGN PATENT DOCUMENTS

| | | |
|---|---|---|
| 2214823 | 8/1974 | France . |
| 844 689 | 7/1952 | Germany . |
| 27 04 688 | 8/1977 | Germany . |

*Primary Examiner*—J. Casimer Jacyna
*Attorney, Agent, or Firm*—Smith-Hill and Bedell

[57] ABSTRACT

A fuel injection valve for an internal combustion engine comprises a valve body structure including a nozzle part formed with a needle passage having at least one nozzle passage at one end, a primary control chamber spaced along the needle passage from the nozzle passage, and a secondary control chamber. The primary control cheer is connected in use to a duct for supplying fuel under pressure. The nozzle part of the valve body structure has a seating surface between the nozzle passage and the primary control chamber. A needle structure is fitted slidably in the needle passage with one end of the needle structure proximate the seating surface. The needle structure has a first control surface that is exposed to pressure of fluid in the primary control chamber, a second control surface at the end of the needle structure proximate the seating surface, and a third control surface exposed to pressure of fluid in the secondary control chamber. The three control surfaces are disposed so that force generated by fluid pressure acting on each of these surfaces has a component urging the needle structure away from the seating surface against the force of a needle return spring. A control valve has a first position in which it communicates pressure of fuel in fuel supply duct to the secondary control chamber and a second position in which it cuts off the pressure of fuel in the fuel supply duct from the secondary control chamber. When the control valve is in its first position, it is urged by the pressure of fuel in the fuel supply duct toward its second position against the force of a control valve return spring.

6 Claims, 4 Drawing Sheets

CONTROL ARRANGEMENT FOR A FUEL INJECTION VALVE

BACKGROUND OF THE INVENTION

This invention relates to a control arrangement for a fuel injection valve for an internal combustion engine, especially for a large diesel engine.

Large diesel engines refer here to such engines that may be applied, for example, for the main propulsion engines or the auxiliary engines for ships or for power plants for producing electricity and/or heat energy. By means of injection valves fuel is injected directly into each cylinder of an engine.

The pressure at which fuel is supplied to a fuel injection valve of a large diesel engine varies periodically in order to control opening and closing of the valve by displacing a needle that is biased toward its closed position by a return spring. The fuel pressure required to displace the needle from its closed position against the force of the return spring is referred to as the opening pressure, and the fuel pressure at which the spring is able to displace the needle back to its closed position is referred to as the closing pressure.

The condition under which fuel is injected, including, e.g., the timing of the injection, the size of the droplets, the fuel pressure, the number of nozzle orifices, the orientation of the nozzle orifices in the combustion chamber, etc., influence significantly the NOx content of the exhaust gases. In an attempt to decrease the creation of nitrogen oxides, improvements have been made in the formation of fuel droplets, both with respect to size and uniformity. The size of the droplets in a fuel spray can be decreased by increasing the pressure of the injection of fuel, which for its part can be achieved for example by means of the design of the injection nozzle and by using higher opening pressure for the nozzle. Increasing the pressure of injection also improves uniformity of droplet size. The operating conditions of the engine and the construction of the nozzle, however, set limits for increasing the opening pressure.

In a conventional nozzle, the pressure of the fuel acts only on one control surface in order to open the valve. In such a nozzle, after the valve is already open, the pressure of the fuel acts not only on the control surface on which it acted for opening the valve but also on the needle of the nozzle through the area of a control surface located at the end of the needle. Because of this increase in area, the closing pressure of the nozzle is substantially smaller than the opening pressure of the nozzle. As a consequence, the fuel pressure must be reduced substantially in order to allow the spring to close the valve and an undesirable fuel injection under low pressure occurs at the end of the injection period, resulting in injection of larger droplets.

SUMMARY OF THE INVENTION

An aim of the invention is to provide a new improved control arrangement for a fuel injection valve by means of which the closing pressure of an injection nozzle of the injection valve and thus the injection pressure at the end of the injection period can with advantage be increased, whereby the formation of droplets in the cylinder of an engine can be improved. A further aim is that the arrangement does not as such require increasing of the opening pressure of the nozzle.

In accordance with the invention there is provided a fuel injection valve for an internal combustion engine, said valve comprising a valve body structure including a nozzle part formed with a needle passage having at least one nozzle passage at one end and a primary control chamber spaced from said one end, the nozzle part having a seating surface between the nozzle passage and the primary control chamber, said primary control chamber being connected in use to a duct for supplying fuel under pressure, and the needle passage also having a secondary control chamber, a needle structure fitted slidably in the needle passage with one end of the needle structure proximate the seating surface, the needle structure having a first control surface that is exposed to pressure of fluid in the primary control chamber, a second control surface at said one end of the needle structure, and a third control surface exposed to pressure of fluid in the secondary control chamber, the first, second and third control surfaces being disposed so that force generated by fluid pressure acting on each of said surfaces has a component directed along the needle structure in a direction from said one end of the needle structure toward an opposite end of the needle structure, a first spring urging the needle structure toward a position in which the second control surface seats as a valve surface against said seating surface, a control valve having a first position in which it communicates pressure of fuel in said duct to the secondary control chamber and a second position in which it cuts off the pressure of fuel in said duct from the secondary control chamber, the control valve being urged by the pressure of fuel in said duct toward its second position when it is in its first position, and a second spring urging the control valve toward its first position.

During an injection cycle having at least a first phase in which the fuel pressure increases for opening the fuel injection valve against the force of the first spring and a second phase in which the fuel pressure decreases, the control valve is in its first position during at least an initial part of the first phase of the injection cycle, in which the fuel injection valve is closed, and is displaced to its second position after the fuel injection valve is open.

In accordance with the invention, before starting the injection of fuel, the control valve is urged by a spring in its first position, in which it communicates the pressure of the fuel to be injected to the third control surface, and after opening of the fuel injection valve the control valve cuts off the connection between the pressure of the fuel to be injected and the third control surface. By making use of the control valve so as to selectively apply the pressure of the fuel to be injected to the third control surface in the way described it is possible to advantageously influence the pressures needed on the one hand for the opening and on the other hand for the closing of the injection nozzle.

In an advantageous embodiment of the invention, a chamber is associated with the control valve. This chamber can be separately connected on the one hand with a fuel feeding duct and on the other hand with the third control surface so that in the first position of the control valve, which precedes the injection of fuel, the fuel feeding duct is connected to the third control surface.

The valve member of the control valve can with advantage be designed to comprise a control surface, which responds to increase in feeding pressure of the fuel by moving the valve member against the force of the second spring so that the connection between the chamber and the fuel feeding duct is cut off at the same time as the chamber connects the third control surface to a substantially unpressurized space.

From the viewpoint of manufacturing, it is advantageous that the control valve and the third control surface be located in a separate part which is between the first control surface in the needle member and the return spring for the injection valve. This is advantageous also due to the fact that in this case the nozzle part of the valve being most susceptible to wear can easily be changed. In this solution the needle member of the injection nozzle can be in a force transmitting connection with a guiding stem of the injection valve by means of a separate lifting member, which is supported to said separate part so that it is moveable in the axial direction and on which the third control surface is located.

By selecting the areas of the second and the third control surfaces, to be at least substantially equal, the closing pressure and the opening pressure of the injection nozzle are mutually equal respectively. Hereby the formation of droplets of the fuel is as advantageous as possible during the whole injection period.

BRIEF DESCRIPTION OF THE DRAWINGS

In the following an embodiment of the invention is described with reference to the attached drawings, in which.

DETAILED DESCRIPTION

Figure 1:
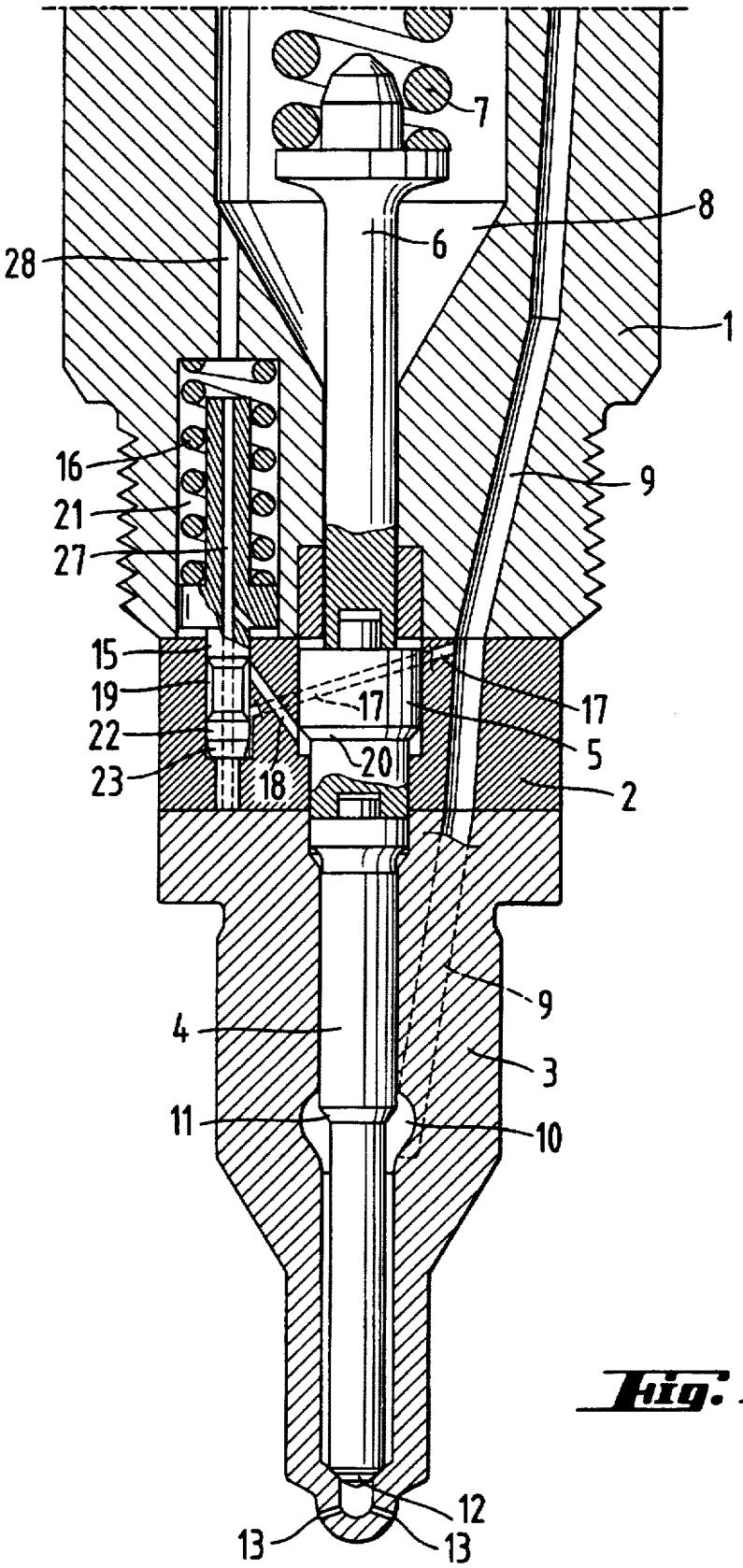
FIG. 1 shows an embodiment of an injection valve according to the invention in section and in closed position.

In the drawings, 1 indicates a body part of an injection valve and 3 an injection nozzle part of the valve, between which there is an intermediate part 2. A lifting member 5 is moveably supported to the intermediate part 2. The lifting member 5 provides a force transmitting connection between a needle member 4 of the nozzle and a guiding stem 6 of the valve. The guiding stem 6 is pressed by a spring 7, located in an unpressurized space 8 in the body part 1, downwards in the figures towards a closed position of the valve.

Figure 2:
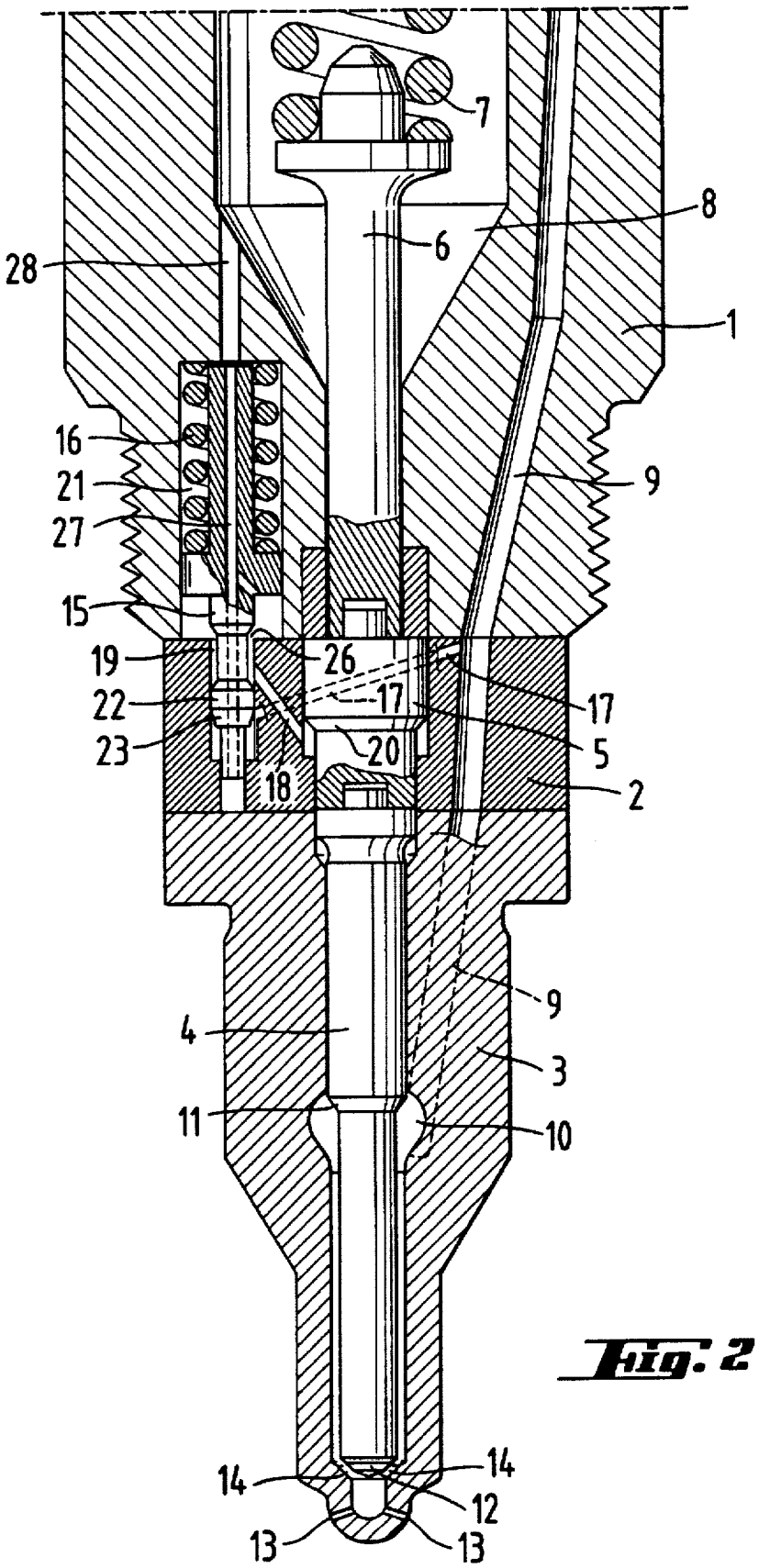
FIG. 2 shows the injection valve of FIG. 1 in opened position.

A fuel injection pump (not shown) has its pressure side connected to a fuel feeding duct 9, which feeds fuel into a chamber 10 in the nozzle part 3. In the chamber 10, the pressure of the fuel acts on a control surface 11 of the needle member 4. In the position of FIG. 1 the needle member 4 of the nozzle is in a closed position, whereby a valve surface 12 engaging a seating surface of the nozzle part 3 prevents injection of the fuel through nozzle passages 13. When the pressure of the fuel in the chamber 10 is high enough that the force effect on the control surface 11 exceeds the spring force of the spring 7, the valve opens and the fuel passes through a valve passage 14 (cf. FIG. 2) between the valve surface 12 and its seating surface into the nozzle passages 13, whereby injection of the fuel takes place. Since in this case the combined area of the control surface 11 and the valve surface 12 serving as a control surface is of course substantially larger than the area of the control surface 11 alone, the pressure of the fuel providing closing of the valve is substantially lower than the pressure of the fuel needed for opening of the valve respectively. As a consequence an injection under low pressure occurs at the end of the injection period, which is undesirable.

In order to avoid the above mentioned phenomenon in accordance with the invention the injection valve is provided with a control arrangement shown in the figures, which includes a control surface 10 on the lifting member 5 located in the intermediate part 2 and a control valve 15 moveable against the force of a spring 16 located in a space 21 in the body part 1, in association with the control valve there being a chamber 19 which is connectable with a passage 17 connected to the fuel duct 9 and a passage 18 being in connection with the control surface 20.

Figure 3:
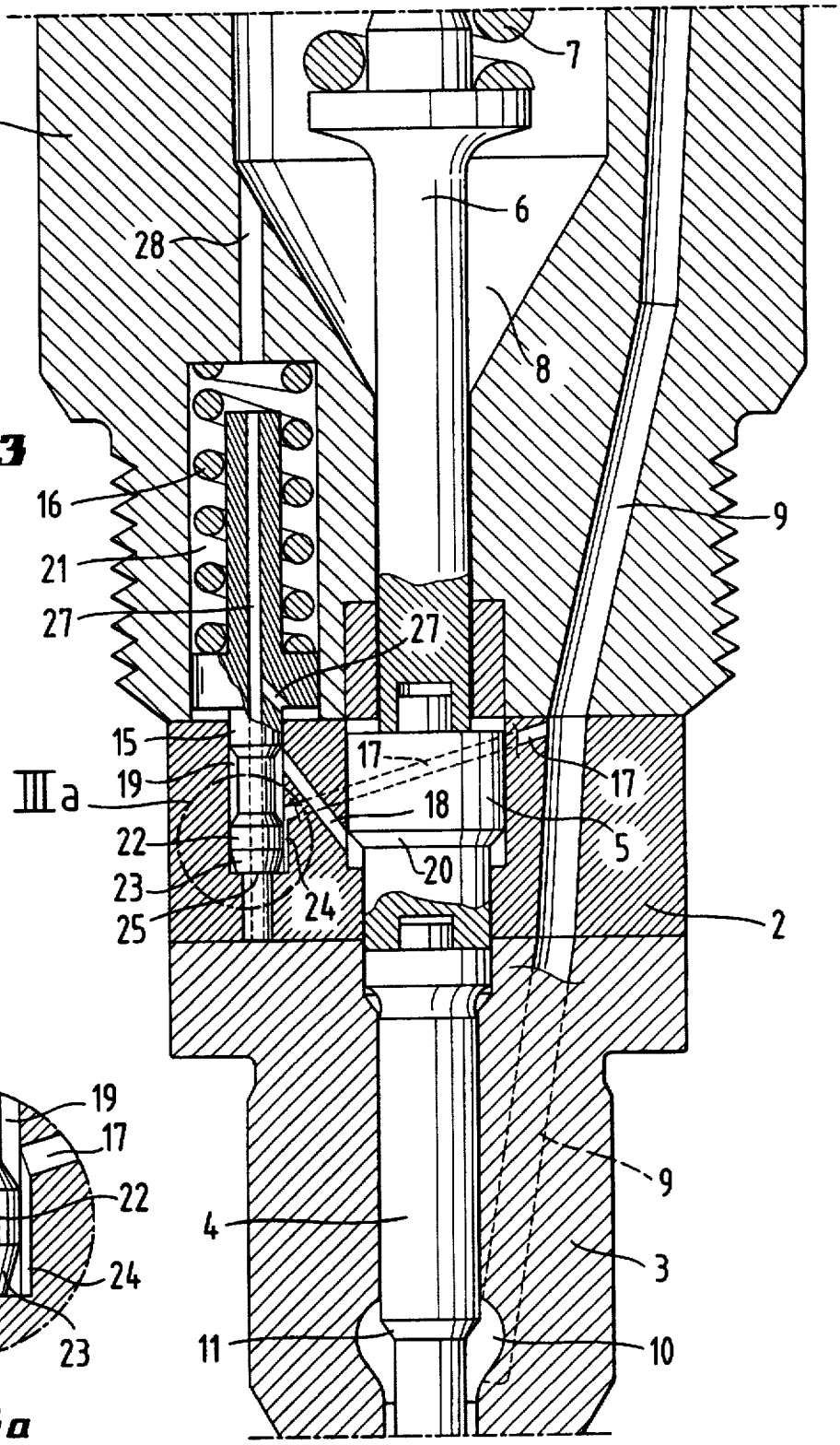
FIGS. 3 and 3*a* show a control arrangement for the injection valve of FIG. 1 as an enlargement.

FIG. 3 corresponds to a situation before opening of the injection valve. Fuel is fed through the duct 9 into the chamber 10, in which it acts on the control surface 11 as described above. At the same time fuel passes through the passage 17 into the chamber 19, from which it passes further through the passage 18 to act on the control surface 20. Thus, the force provided by the pressure of the fuel and lifting the needle member 4 against the force of the spring 7 acts in this case through both of the control surfaces 11 and 20. When the force due to the pressure of the fuel acting on the control surfaces 11 and 20 exceeds the force of the spring 7 the injection of fuel starts. In practice the pressure can then be for example 600 bar.

Figure 3A:
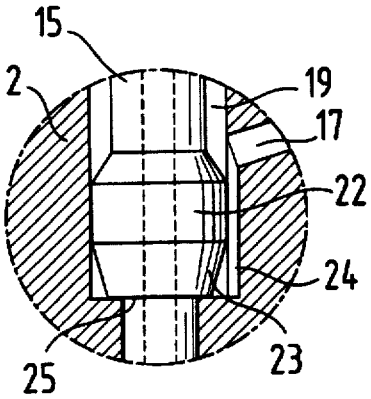

As is more clearly apparent from FIG. 3*a*, the fuel pressure acts also through a passage 24 on a control surface 23 located on the control valve 15 thereby tending to lift the control valve 15 upwards in the figures against the force of the spring 16. When the feeding pressure of the fuel increases for instance up to 1000 bar, the control valve 15 moves against the force of the spring 16 from the position shown in FIG. 3 to the position shown in FIGS. 2 and 4. In this position, a surface 22 in the control valve 15 cuts off the connection between the passages 17 and 18. Thus, the pressure of the fuel to be fed can no longer act on the control surface 20, but the control surface 20 is connected to the unpressurized space 8 through the passage 18, the chamber 19 and passages 26, 27 and 28. The control valve 15 remains in this position during the whole remaining time of the injection period. When the control valve 15 is in its upper position, the fuel pressure acts only on the control surfaces 11 and 12, whereby the injection period is finished when the compression force of the spring 7 exceeds the force due to the fuel pressure acting on the surfaces 11 and 12. When the areas of the control surfaces 20 and 12 are selected to be equal, the opening pressure of the valve corresponds to the closing pressure of the valve. In this way it is possible by means of the arrangement according to the invention to avoid fuel injection with lower pressure at the end of the injection period.

Figure 4:
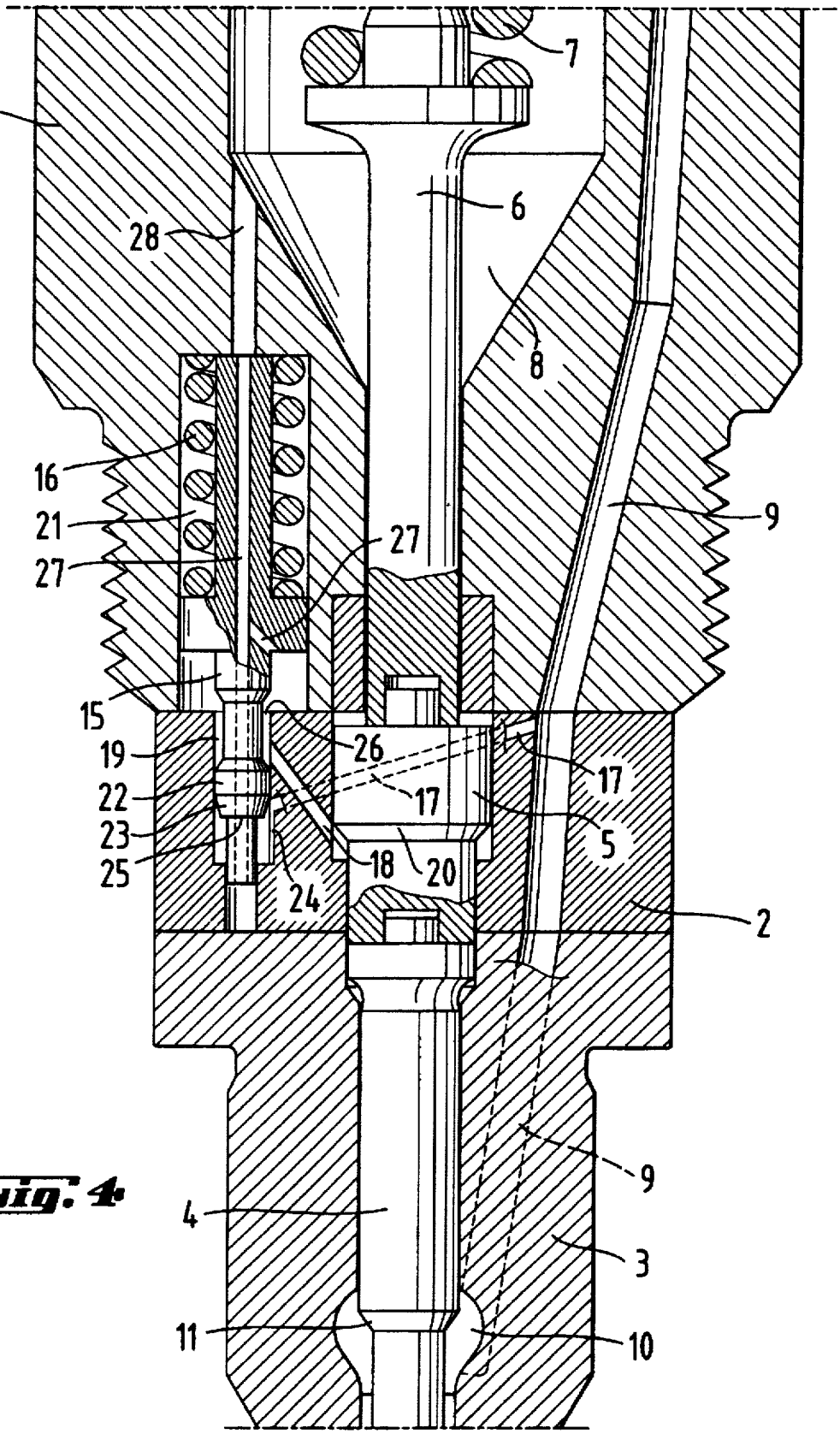
FIG. 4 shows an enlargement of a control arrangement for the injection valve of FIG. 2 in a position in which the injection valve itself is already closed in contrast to the situation in FIG. 2.

After closing of the valve, in practice, the control valve 15 remains pressed against the force of the spring 16 for a moment as is shown in FIG. 4, since although the pressure of the fuel has already substantially decreased, the fuel pressure acts through the passage 17 not only on the surface 23 but also on the surface 25 of the control valve 15. The control valve 15 moves back into the position of FIG. 3 for a new injection period only when the force of the spring 16 exceeds again the force due to the pressure of the fuel acting on the valve 15, which in practice can then be for instance 200 bar.

The invention is not limited to the embodiment shown, but several modifications are feasible within the scope of the attached claims.

I claim:

1. A fuel injection valve for an internal combustion engine, said valve comprising:

a valve body structure including a nozzle part formed with a needle passage having at least one nozzle passage at one end and a primary control chamber spaced from said one end, the nozzle part having a seating surface between the nozzle passage and the primary control chamber, said primary control chamber being connected in use to a duct for supplying fuel under pressure, and the needle passage also having a secondary control chamber, a needle structure fitted slidably in the needle passage with one end of the needle structure proximate the seating surface, the needle structure having a first control surface that is exposed to pressure of fluid in the primary control chamber, a second control surface at said one end of the needle structure, and a third control surface exposed to pressure of fluid in the secondary control chamber, the first, second and third control surfaces being disposed so that force generated by fluid pressure acting on each of said surfaces has a component directed along the needle structure in a direction from said one end of the needle structure toward an opposite end of the needle structure, a first spring urging the needle structure toward a position in which the second control surface seats as a valve surface against said seating surface, a control valve having a first position in which it communicates pressure of fuel in said duct to the secondary control chamber and a second position in which it cuts off the pressure of fuel in said duct from the secondary control chamber, the control valve being urged by the pressure of fuel in said duct toward its second position when it is in its first position, and a second spring urging the control valve toward its first position.

2. A fuel injection valve according to claim 1, wherein the control valve is fitted in a control valve chamber and the fuel injection valve is formed with passages connecting the control valve chamber to said duct and to the secondary control chamber so that when the control valve is in the first position said duct is connected to the secondary control chamber.

3. A fuel injection valve according to claim 2, wherein the control valve comprises a valve member having a control surface that is exposed to pressure of fuel in said duct when the control valve is in the first position and is disposed so that force generated by fluid pressure acting thereon has a component urging the control valve toward the second position.

4. A fuel injection valve according to claim 1, wherein the control valve connects the secondary control chamber to a substantially unpressurized space when in the second position.

5. A fuel injection valve according to claim 1, wherein upon movement of the control valve from the first position toward the second position, the control valve connects the secondary control chamber to a substantially unpressurized space at substantially the same time as it cuts off the pressure of fuel in said duct from the secondary control chamber.

6. A fuel injection valve according to claim 1, wherein the second and third control surfaces have substantially equal effective areas respectively.

* * * * *